US005429416A

United States Patent [19]

Lofy

[11] Patent Number: 5,429,416

[45] Date of Patent: Jul. 4, 1995

[54] SELF-SUPPORTING ARM ELEVATOR

[75] Inventor: Stephen J. Lofy, Bakersfield, Calif.

[73] Assignee: North Coast Medical, Inc., San Jose, Calif.

[21] Appl. No.: 36,824

[22] Filed: Mar. 25, 1993

[51] Int. Cl.[6] ..... A47C 7/54

[52] U.S. Cl. ..... 297/411.23; 297/411.45; 297/466; 297/DIG. 4

[58] Field of Search ..... 297/194, 411.2, 411.23, 297/411.26, 411.45, 466, DIG. 4

[56] References Cited

U.S. PATENT DOCUMENTS

| | | | |
|---|---|---|---|
| 3,191,994 | 6/1965 | Boyce | 297/411.2 |
| 4,265,232 | 5/1981 | Stonich | 128/133 |
| 4,270,235 | 6/1981 | Gutmann | 5/431 |
| 4,285,544 | 8/1981 | Zapf | 297/440.21 |
| 4,576,351 | 3/1986 | Brink | 297/411.26 X |
| 4,813,745 | 3/1989 | Woody | 297/464 |
| 5,060,638 | 10/1991 | Bodine, Jr. | 297/466 X |

*Primary Examiner*—Peter R. Brown
*Attorney, Agent, or Firm*—Malcolm B. Wittenberg

[57] ABSTRACT

A device and method for positioning a human arm above the arm of a chair, the device being made of a soft pliable material and including a lower chair-adapting portion with one or more passageways approximating the shape of an arm of a chair adapted to fit securely around the arm of the chair, and a connected upper arm-elevating portion with a relatively low portion to accommodate and support an elbow and an angled, elevated portion to accommodate, support, and elevate an arm and hand. The method includes using the device and also positioning a person against the device, providing extra stability for the device and limiting the lateral motion of the person in the chair.

20 Claims, 2 Drawing Sheets

SELF-SUPPORTING ARM ELEVATOR

FIELD OF THE INVENTION

This invention relates to a self-supporting arm elevator. More particularly, this invention relates to an arm elevator constructed of a firm but resilient material, shaped to be conformable to a wide variety of armrests and chairs.

BACKGROUND

Doctors and therapists often need to position a patient's arm, particularly after surgery or stroke. Foam arm elevators have been used to elevate the affected upper extremity of a wheelchair bound patient in order to prevent swelling in that extremity, especially in the hand and wrist. Arm elevators also have been used to prevent unnecessary motion of the patient's arm, which can lead to painful bruising or subluxation.

Many stroke victims suffer hemiplegia, coupled with sensory loss to the affected side. The patient is often unable to detect long periods of pressure or contact with sharp objects which may cause bruising or even cutting fragile skin, particularly for elderly individuals or individuals medicated with blood thinning agents.

For a patient with limited shoulder musculature, such as occurs with paralysis after a stroke, movement of the patient's elbow down or away from the body can cause shoulder subluxation, the separation of the head of the humerus from the glenohumeral joint, which is often accompanied by pain. Current devices are not always stable and may move, causing elbow movement as well. As the elbow moves away from the trunk of the seated patient, support of the head of the humerus in the glenohumeral joint decreases.

Existing arm elevators must rest on a supporting or securing device, typically a relatively wide surface such as a lap tray, a half-lap tray, or plastic supporting device designed to receive the arm elevator. See North Coast Medical, Inc. 1993 ADL Catalog, Item NC94133 on page 112. Some such supporting devices are designed with vertical portions to form a bounded tray so the arm elevator cannot slip off. See North Coast Medical, Inc. 1993 ADL Catalog, Items NC96560 and NC94108 on page 105. Some such devices can be adjusted to a selected height or angle. The supporting or securing items are an additional expense required in order to use an arm elevator with a wheelchair.

Foam arm elevators are presently in high demand throughout the therapy industry due to their comfort for patients and the minimal risk they pose for causing skin breakdown (decubiti). The inexpensive material (foam) makes the item disposable.

Existing arm elevators do not provide a wholly satisfactory solution to some of the problems mentioned above. Existing arm elevator devices simply rest on a lap tray, often resulting in shifting of the foam. Many of the existing arm elevator devices can put unnecessary pressure on a patient's skin and cause bruising. Many of the existing arm elevator devices are relatively thin. If such a device is placed on a thick tray or support it will provide a certain height for a patient's shoulder, but when placed on a different tray will provide a different shoulder height. A consistent and desirable height would be preferred to the range of heights for current arm elevators.

Current securing devices are generally constructed from plastic or other rigid materials, each of which are designed to fit only a limited number of chairs, resulting in poor or inconsistent fits to the variety of wheelchair armrest shapes and sizes on the market. A more adaptable arm elevator device would eliminate these inconsistencies.

SUMMARY OF THE INVENTION

The current invention provides a device and method for positioning a human arm above the arm of a chair, the device including a lower portion designed to fit around the arm of a chair, and a connected upper portion with a relatively low portion to accommodate an elbow and an angled, elevated portion to accommodate and elevate an arm and hand. The method includes using the device and also positioning a person against the device, providing extra stability for the device and limiting lateral motion of the person in the chair.

One object of the present invention is to provide an improved support device to stabilize and position a patient's arm.

A further object of this invention is to improve patient comfort while keeping an arm elevated.

A further object of this invention is to help a patient remain seated comfortably in a chair, particularly a wheelchair.

DETAILED DESCRIPTION OF THE INVENTION

Figure 1:
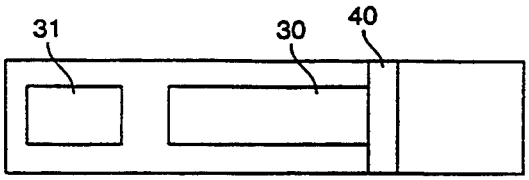
FIGS. 1, 2, 3 and 4 illustrate top, three dimensional, rear and bottom views, respectively, of a preferred embodiment of a self-supporting arm elevator.
Figure 2:
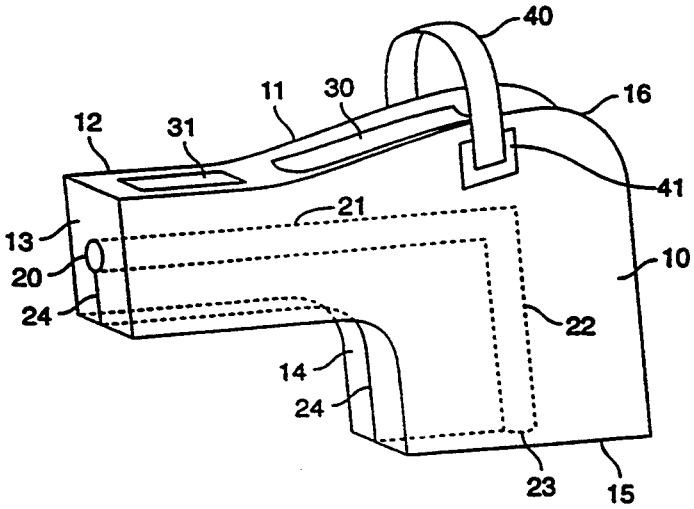
Figure 3:
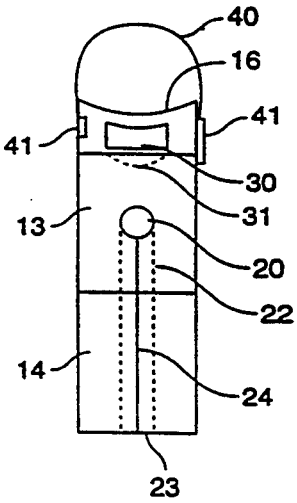
Figure 4:
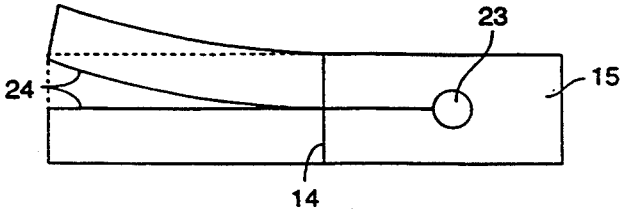

The new arm elevator is foam with cut passageways approximating the size and shape of a standard wheelchair armrest. Referring to the top, perspective, rear and bottom views in FIGS. 1, 4, 3 and 2, the lower portion of arm elevator 10 has hole 21 drilled forward from the rear opening 20 in rear portion 13, hole 22 drilled up from bottom opening 23 in bottom portion 15, and slit 24 between each hole and the inner portion 14 of arm elevator 10, allowing the arm elevator to be pried apart to slip over a support such as an armrest of a chair or wheelchair armrest (not shown). FIG. 4 shows slit 24 opened somewhat. The density and elasticity of the foam material tends to return arm elevator 10 to its resting position, forming a snug fit around the armrest. The device is functional even if the arm only fits approximately in the cut passageways because the foam can deform to accommodate a wide variety of arm configurations. Arm elevator 10 extends down along both sides of the armrest, with the inside positioned near or next to an occupant of the chair. The pressure of the relaxed occupant leaning against the foam wedges the section of foam between the occupant and the armrest, further stabilizing arm elevator 10.

Figure 5:
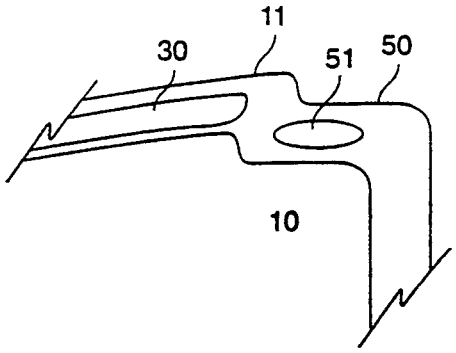
FIGS. 5, 6 and 7 illustrate another embodiment of the top of an arm elevator, with optional hand positioning aids.
Figure 6:
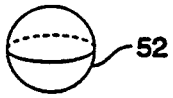
Figure 7:
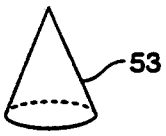

The upper portion 54 of arm elevator 10 includes flat top portion 12 to hold a patient's elbow and angled portion 11 to elevate a patient's hand above the elbow, with the hand on the front portion of arm elevator 10. A preferred embodiment includes one or both of troughs 30 and 31 in angled portion 11 and top portion 12 to accommodate and stabilize a patient's arm. In one preferred embodiment, illustrated in FIG. 5, angled portion 11 is cut away to form platform 50 with depressed area 51 to accommodate a variety of hand positioning aids such as sphere 52 and cone 53 illustrated in FIGS. 6 and 7. See North Coast Medical, Inc. 1993 ADL Catalog, Items NC15565 and NC15528 on page 112.

The preferred embodiment incorporates strap 40 to stabilize the hand on the arm elevator, thus preventing an accidental fall of the upper extremity to the outside of the wheelchair with the potential for bruising or tearing skin or for aggravating subluxation. The strap is not required but provides additional functionality and stability for a patient. In a preferred embodiment, strap 40 includes Velcro ® portions to connect to pads 41 on either side of arm elevator 10.

The new arm elevator fits snugly to a wide variety of wheelchair armrests. When fitting the new arm elevator to some odd sized or odd shaped wheelchairs and armrests, a shorter securing device may be required. The new arm elevator can be readily modified with only an ordinary pair of scissors.

The new arm elevator has many advantages. It can be used on either the fight or left armrest without modification. It needs no additional supporting or securing device, resulting in a lower overall cost. It provides a stable support to a patient's elbow and minimizes shoulder subluxation. Because the entire device is constructed out of foam it provides a comfortable, nonabrasive, low pressure surface for the patient's upper extremity and trunk. Because the device does not require a full lap tray it will not restrict access in and out of a wheel chair by the patient, furthering compliance with 1991 Federal Government regulations regarding restraints for patients.

Arm elevator 10 provides an additional benefit in helping a patient sit in a wheelchair. The foam takes up some space in the seating portion of the wheelchair, wedging the patient into the chair. The foam is springy and so provides an elastic cushion tending to displace the patient against the opposite side of the wheelchair, thereby limiting lateral movement and gently squeezing the patient in place. Many patients tend to lean toward a special support such as the arm elevator, so a patient will naturally slide toward the foam and increase this springing action. This slide or lean incidentally improves the stability of the entire arm elevator by increasing the pressure of the arm elevator against the armrest, thereby increasing the friction between the arm elevator and the armrest. In addition, the friction properties of the foam reduce the likelihood that a patient will slip forward out of the wheelchair.

A preferred embodiment of the arm elevator provides this method of stabilizing a human arm above the arm of a chair, where the arm elevator 10 includes a lower chair-adapting portion 55 with one or more passageways 21, 22 approximating the shape of an arm of a chair and adapted to fit securely around the chair arm. This lower, chair-adapting portion has an outer portion extending outwardly from the chair and an inner portion extending inwardly toward the chair. The arm elevator also has an upper arm-elevating portion 54 connected to the lower chair-adapting portion. This upper arm-elevating portion accommodates and elevates a human arm and hand. In this method, the lower, chair-adapting portion of the invention is positioned around the arm of the chair, a person is seated in the chair, and one of the person's arms is placed on the upper arm-elevating portion of the invention 11, 12. When the person is positioned against the portion extending inwardly, the friction between the device and the chair arm is increased.

A preferred embodiment of the device also provides a method for securing a person seated in the chair by restricting lateral movement of the person because the lower chair-adapting portion of the arm elevator extends inwardly towards the center of the chair. In addition, a preferred embodiment of the arm elevator further provides a method for limiting lateral or other movement of the person's elbow by positioning the elbow on the device.

The exact dimensions of the arm elevator can be adjusted to accommodate specific chairs, if needed. In general, it is preferred that the distance between top portion 12 and the top of rear opening 20 of hole 21 be greater than about one inch (2.5 cm), preferably on the order of 2.5 to 4 inches (6.25 to 10 cm). This provides a useful height for the patient's elbow for most patients in most chairs.

Figure 8:
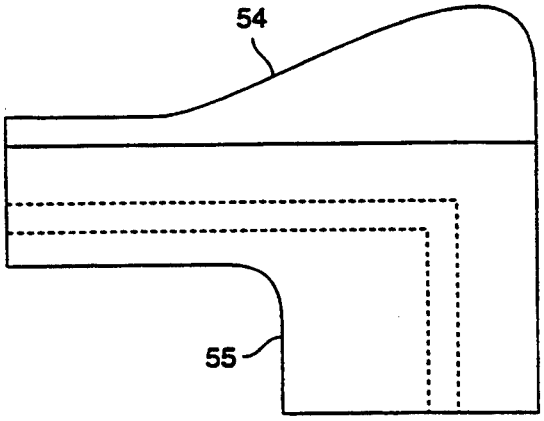
FIGS. 8 and 9 illustrate another embodiment of an arm elevator.
Figure 9:
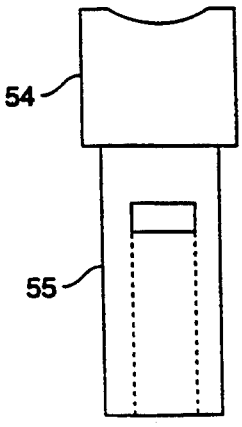

The arm elevator may be made of a variety of materials and may be made of one or more pieces of material. In a preferred embodiment, the sides are tapered so that angled portion 11 is wider than bottom portion 15, e.g. 4 inches (10 cm) tapering to 3 inches (7.5 cm). Other configurations are also useful, especially including vertical sides with no taper. FIGS. 8 and 9 illustrate an embodiment made from two pieces of foam. An arm elevator made of two pieces, a top and bottom, allows interchanging different tops, e.g. one with the shape shown in FIG. 2 and another with the shape shown in FIG. 5. Upper arm-elevating portion 54 can be detachably secured to lower, chair-adapting portion 55.

A description of the device and method of using the present invention as well as a preferred embodiment of the present invention has been set forth above. One skilled in the art will recognize and be able to practice many changes in many aspects of the device and method described above, including variations which fall within the teachings of this invention. The spirit and scope of the invention should be limited only as set forth in the claims which follow.

What is claimed is:

1. A device for positioning a human arm above an arm of a chair, said device comprising:

a lower, chair-adapting portion comprising a block of material containing a generally L-shaped passageway means for engaging horizontal and vertical upright portions of the arm of a chair, the walls of said passageway comprising a pliable material, said L-shaped passageway means adapted to secure the device on the arm of said chair, and an upper, arm-elevating portion connected to said lower chair-adapting portion, said upper, arm-elevating portion further comprising an angled, elevated portion to accommodate, support, and elevate a human arm and hand.

2. The device of claim 1 in which said generally L-shaped passageway means is designed to secure said device to said arm of said chair.

3. The device of claim 1 further comprising a trough in said angled, elevated portion.

4. The device of claim 1 wherein said upper, arm-elevating portion further comprises a relatively low portion to accommodate and support a human elbow.

5. The device of claim 4 further comprising a trough in said relatively low portion.

6. The device of claim 4 wherein a first portion of said generally L-shaped passageway means is approximately horizontal.

7. The device of claim 6 wherein said first passageway means is about 2.5 to 10 centimeters below said relatively low portion of said upper arm-elevating portion.

8. The device of claim 4 further comprising
a hand positioning aid and
an area near the top of said angled, elevated portion having means to receive and mechanically support said hand positioning aid.

9. The device of claim 1 further comprising a strap means on said upper portion for securing said human arm.

10. The device of claim 1 wherein said device comprises a pliable material.

11. The device of claim 10 wherein said pliable material is neoprene foam.

12. The device of claim 1 further comprising an integral upper arm-elevating and lower chair-adapting portion.

13. A device for positioning a human arm above an arm of a chair, said device comprising:
an upper arm-elevating portion comprising
an angled, elevated portion to accommodate, support and elevate a human arm and hand, and
a lower chair-adapting portion comprising a block of material containing a generally L-shaped passageway means having interconnected first and second portions comprising the L-shape for engaging horizontal and vertical upright portions of the arm of a chair, the walls of said passageway means comprising a pliable material, said chair-adapting portion adapted to secure the device to the arm of said chair,
said first portion of said passageway means being approximately horizontal when positioned on said arm and designed to accommodate the arm of the chair, and
said second portion of said passageway means connected to said first portion of said passageway means, said second portion of said passageway means being approximately vertical when positioned on said upright portion and designed to accommodate the upright portion of the arm of the chair.

14. The device of claim 13 wherein said lower, chair-adapting portion has a bottom surface, and a rearward surface which abuts the bottom surface, said device further comprising a slit substantially in the form of a plane defined by and bounded by said first and said second portions of the generally L-shaped passageway means and extending to said bottom and rearward surfaces.

15. The device of claim 13 wherein said lower, chair-adapting portion has a bottom surface and a rearward surface which abuts the bottom surface, said device further comprising a slit defined by and bounded by said first and said second portions of the generally L-shaped passageway means and extending to said bottom and rearward surfaces.

16. A device for positioning a human arm above an arm of a chair, said device comprising:
a lower, chair-adapting portion comprising a block of material containing a generally L-shaped passageway means the walls of said passageway comprising a pliable material, said L-shaped passageway means adapted to secure the device to the arm of said chair, and
a detachable upper, arm-elevating portion detachably connected to said lower portion, by interconnecting means said upper portion further comprising
an angled, elevated portion to accommodate, support, and elevate a human arm and hand.

17. A device for positioning a human arm above an arm of a wheelchair, said device comprising:
a lower, chair-adapting portion comprising a block of material containing a generally L-shaped passageway means the walls of said passageway means comprising a pliable material, said L-shaped passageway means adapted to secure the device to the arm of said chair, and
an upper, arm-elevating portion connected to said lower chair-adapting portion, said upper, arm-elevating portion further comprising
an angled, elevated portion to accommodate, support, and elevate a human arm and hand.

18. A method of stabilizing a human arm using an arm elevator to securely position a human arm above an arm of a chair,
said arm elevator comprising
a lower, chair-adapting portion comprising a block of material containing a generally L-shaped passageway means the walls of said passageway means comprising a pliable material, said L-shaped passageway means adapted to secure the device to the arm of said chair, said lower, chair-adapting portion further comprising an outer portion extending outwardly from said chair and an inner portion extending inwardly said chair, and
an upper arm-elevating portion connected to said lower chair-adapting portion, said upper arm-elevating portion further comprising
a relatively low portion to accommodate a human elbow and
an angled, elevated portion to accommodate and elevate a human arm and hand,
said method further comprising
positioning said lower chair-adapting portion of said device around the arm of the chair,
seating a person in the chair,
positioning the person against said inwardly extending portion of said lower, chair-adapting portion of the device, to increase friction between said device and said chair arm, and
placing one of the person's arms on said device.

19. The method of claim 16 further comprising securing the person in the chair to restrict lateral motion of the person in said chair.

20. The method of claim 18 further comprising positioning the elbow of said person's arm on said device to limit lateral or other movement of the elbow.

* * * * *